United States Patent [19]

Parfitt

[11] 4,238,799

[45] Dec. 9, 1980

[54] WINDSHIELD MOUNTED HALF-WAVE COMMUNICATIONS ANTENNA ASSEMBLY

[75] Inventor: Dale R. Parfitt, Lake Worth, Fla.

[73] Assignee: Avanti Research & Development, Inc., Addison, Ill.

[21] Appl. No.: 890,380

[22] Filed: Mar. 27, 1978

[51] Int. Cl.[3] ..... H01Q 1/32

[52] U.S. Cl. ..... 343/715; 343/745; 343/749

[58] Field of Search ..... 343/713, 715, 745, 850, 343/895, 718, 749, 860, 861

[56] References Cited

U.S. PATENT DOCUMENTS

| | | | |
|---|---|---|---|
| 1,715,952 | 6/1929 | Rostron | 343/850 |
| 2,829,367 | 4/1958 | Rychlik | 343/850 |
| 2,941,204 | 6/1960 | Bailey | 343/745 |
| 2,963,704 | 12/1960 | Yates et al. | 343/895 |
| 3,264,647 | 8/1966 | Nuttle | 343/745 |
| 3,945,014 | 3/1976 | Kunert et al. | 343/713 |
| 4,089,817 | 5/1978 | Kirkendall | 343/850 |

FOREIGN PATENT DOCUMENTS

| | | | |
|---|---|---|---|
| 2537290 | 4/1976 | Fed. Rep. of Germany | 343/713 |
| 2,543,973 | 8/1976 | Fed. Rep. of Germany | 343/713 |
| 1314455 | 12/1962 | France | 343/713 |

*Primary Examiner*—Eli Lieberman

*Attorney, Agent, or Firm*—Dressler, Goldsmith, Shore, Sutker & Milnamow, Ltd.

[57] ABSTRACT

A half-wave length communications antenna assembly especially adapted to be mounted on non-conductive surfaces, such as on a window of a vehicle. The antenna assembly desirably includes an electrically shortened half-wave inductively loaded radiating whip loaded at its base end by a loading capacitor plate to be fixed to a non-conductive surface. The whip is coupled through the non-conductive surface to a transmission line internally of the vehicle by a coupling capacitor plate which, with the loading capacitor plate, forms a coupling capacitor. A tuned circuit which is tuned to the nominal resonant frequency of the whip is connected to the coupling capacitor plate and serves as an impedance matching circuit between the half-wave whip and the transmission line. The tuned circuit also affects the radiation pattern of the whip to produce a pattern more typical of a five-eighths wave length antenna to provide somewhat greater gain.

28 Claims, 4 Drawing Figures

WINDSHIELD MOUNTED HALF-WAVE COMMUNICATIONS ANTENNA ASSEMBLY

BACKGROUND OF THE INVENTION

Typically, mobile communications antennas, such as those for use in the citizens band, are quarter wave-length, ground plane antennas. Size is the primary reason the quarter wave-length antenna is so prevalent, particularly for the citizens band frequency range. One-half wave-length in the citizens band frequency is approximately eighteen feet. It is quite clear that such an antenna is much too long for use as a mobile whip. Even the quarter wave-length antenna, which is approximately nine feet in length for the citizens band, is too long for most mobile installations, although some in fact do exist.

Most mobile antennas are electrically shortened, i.e., inductively loaded, quarter wave-length whips grounded to the vehicle to which they are attached. One reason for utilizing the ground plane quarter wave-length antena is that the feed point, which is a relatively low impedance point of the antenna, can be easily matched to the usual fifty ohm impedance of transmission lines. Since the quarter wave-length mobile ground plane antenna must be suitably grounded to the vehicle to which it is mounted, it requires some conductive surface to act as the ground plane, e.g., the body of the vehicle. Non-metallic automobile bodies and boats are typical examples of environments in which a ground plane is not readily available. Of course, this means that typical ground plane antennas may not readily be used in such environments.

There are a variety of techniques and devices for mounting ground plane antennas to vehicles. Antennas may be attached to a vehicle magnetically, by clips or clamps, or by drilling a hole through the surface of the body. The ground plane connections are usually conductive, although magnetic antennas are most often capacitively grounded to the surfaces on which they are magnetically retained. With magnetic mounts the cable must still pass through the car body, such as through a partially opened window, and cracking and breaking of the cable too frequently occurs. Many vehicles are not adaptable to the clip or clamp type mounts and therefore are limited to use of permanently mounted antennas, requiring a hole in the body, or to magnetic antennas. At the same time, many mobile radio operators are not satisfied with magnetic type antennas, and have no desire to punch or cut holes in their vehicle body.

It would be desirable, therefore, to have available a suitable mobile antenna which could be mounted to the surface of a non-conductive body or which could suitably be mounted to a vehicle to which other antennas are not adaptable and which is easily and rapidly mountable, while providing operating characteristics and radiation patterns which are equivalent to the usual inductively loaded quarter wave-length antennas.

SUMMARY OF THE INVENTION

In accordance with the present invention, there is provided a half-wave communications antenna assembly, typically electrically shortened and inductively loaded, which may be mounted on a non-conductive surface, especially of a vehicle body, and which provides excellent operating characteristics.

One embodiment of an antenna assembly incorporating the present invention includes a resonant half-wave inductively loaded radiating member or whip loaded at its base end by a capacitor plate adapted to be affixed to a non-conductive surface on the vehicle. The antenna is coupled to a trasmission line through the non-conductive surface to which it is attached by use of a coupling plate which combined with the loading plate to form a coupling capacitor at the high impedance point or voltage loop of the antenna.

A tuned circuit connected to the interior or coupling plate is tuned to the resonant frequency of the antenna assembly. The end of the tuned circuit connected to the plate exhibits a high impedance, and the other end, being appropriately grounded, exhibits a negligible impedance. In this way, the transmission line can be connected to the tuned circuit, for example, to a tapped coil forming part of the tuned circuit, at an impedance point which matches the impedance of the transmission line.

Since the antenna of the system of the present invention does not require a ground plane and may be affixed to a non-conductive portion of the vehicle body, it provides an antenna system having versatility and utility which is not limited to installations which require a conductive body. Such an antenna assembly can conveniently be attached and affixed to non-conductive vehicles or to non-conductive portions of such vehicle, and produces a radiation pattern which is more independent of the configuration of the vehicle to which it is mounted than a ground plane antenna.

In one embodiment of the present invention, the antenna system is designed to be affixed to one of the windows of an automobile with the tuning or loading plate connected to the outside surface of the window and the coupling or internal plate being connected to the internal surface in juxtaposition with the tuning or loading plate. A tuned circuit including a tapped coil and a capacitor is connected to the tuning plate to provide an impedance match to the transmission line.

In accordance with one aspect of the present invention, the antenna assembly of the present invention utilizes an electrically shortened antenna whip of dimensions that are practical for mobile use in the citizens band frequency and which does not physically overload the mounting to the glass surface. For example, an electrically shortened, loaded antenna whip or radiating member having a dimension of approximately two to three feet can be continuously loaded by a helical coil extending substantially the length of the whip. The base end of such a radiator is connected to a capacitor plate having sufficient dimension to at least partially tune and load the antenna whip. The resulting antenna assembly produces a radiation pattern at an efficiency generally equivalent to typical quarter wave ground plane antennas, requires no holes, and may be mounted on any suitable and available non-conductive surface, such as a vehicle windshield or rear window or non-conductive body itself.

The high end impedance of a shortened half wave whip is particularly suitable for capacitive coupling through the non-conductive surface on which the antenna is mounted. The coupling capacitor is formed by the loading plate mounted on the external surface of a non-conductive body which also acts as a loading and tuning capacitor plate for the inductively loaded antenna whip. The other plate of the coupling capacitor is disposed on the inner surface of the non-conductive portion in juxtaposition with the loading plate.

A tuned circuit is connected to the coupling or internal plate. The remote end of the tuned circuit, which can take the form of a parallel tuned circuit resonant at the nominal design or resonant frequency of the antenna assembly, is grounded. The tuned circuit displays a varying impedance, extremely high at the point where it is connected to the internal or coupling plate at the base end of the antenna system or assembly and very low or negligible at the point where the tuned circuit is connected to ground.

This tuned circuit exhibits certain characteristics of a quarter wave length radiator, (e.g., resonance, high impedance at one end, and low impedance at the other) but in conjunction with the shortened half wave whip produces an assembly which appears to simulate certain characteristics of five-eighths wave antenna system. See, for example, Orr and Cowan, "The Truth About CB Antennas", Radio Publications, Inc. 1976, pages 47–48, 74–75. This tuned circuit which is also an impedance matching circuit between the half-wave antenna assembly and the transmission line, appears to affect the radiation pattern of the half wave antenna to produce a lower pattern more typical of a five-eighths wave length antenna, thereby achieving some degree of gain over what might otherwise be expected, a significant advantage when utilizing the physically shortened inductively loaded whip.

In one embodiment of the present invention, the tuned circuit is contained within a non-shielded housing allowing whatever radiation that does exist to emanate from the tuned circuit. The effect of such radiation along with the impedance matching characteristic of the tuned circuit is particularly noticeable in connection with a shortened antenna incorporated in the assembly of the present invention.

The loading plate forming part of the coupling capacitor appears to be multifunctional. Not only does the surface area of the loading plate act as a capacitor plate for the coupling capacitor, but it also capacitively loads the antenna. If the loading plate has any depth, it effectively alters the length of the antenna assembly thereby lowering the nominal resonant frequency for which the antenna is tuned which may be further affected at least in part by the capacitive effect between the loading plate and any metallic portion of the body surrounding it or adjacent to it.

The nominal resonant frequency of the antenna may be further adjusted by providing a means for varying the surface area of the loading plate. In one embodiment of the present invention the loading plate is provided with a movable member which may be extended or retracted laterally or transversely to the axis of the antenna whip to vary the surface area of the loading plate and thereby fine tune the antenna to a particular frequency within the frequency band for which the antenna is designed.

In the disclosed embodiment, the shortened antenna whip is continuously loaded by a helical coil extending a substantial portion of the length of the elongated radiator or whip. If desired, an adjustable tip portion may also be provided at the end of the helical coil for length adjustment of the whip to fine tune the antenna.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DESCRIPTION OF PREFERRED EMBODIMENT

Figure 1:
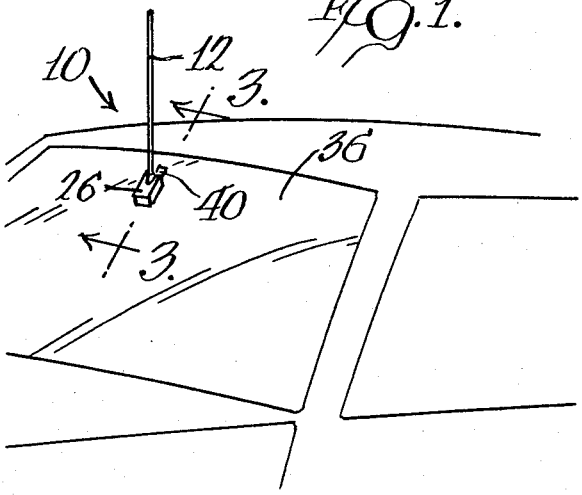
FIG. 1 is a perspective view showing the antenna assembly of the present invention installed on a window of a vehicle.
Figure 2:
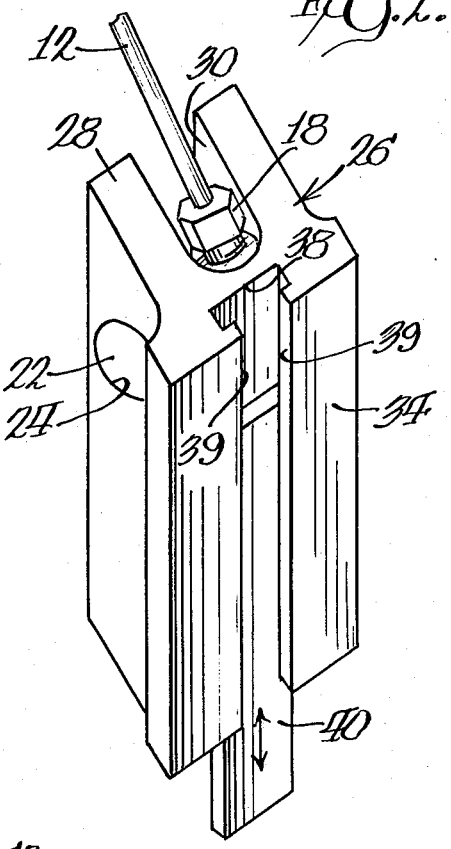
FIG. 2 is an enlarged perpsective view of a portion of the assembly of the present invention.
Figure 3:
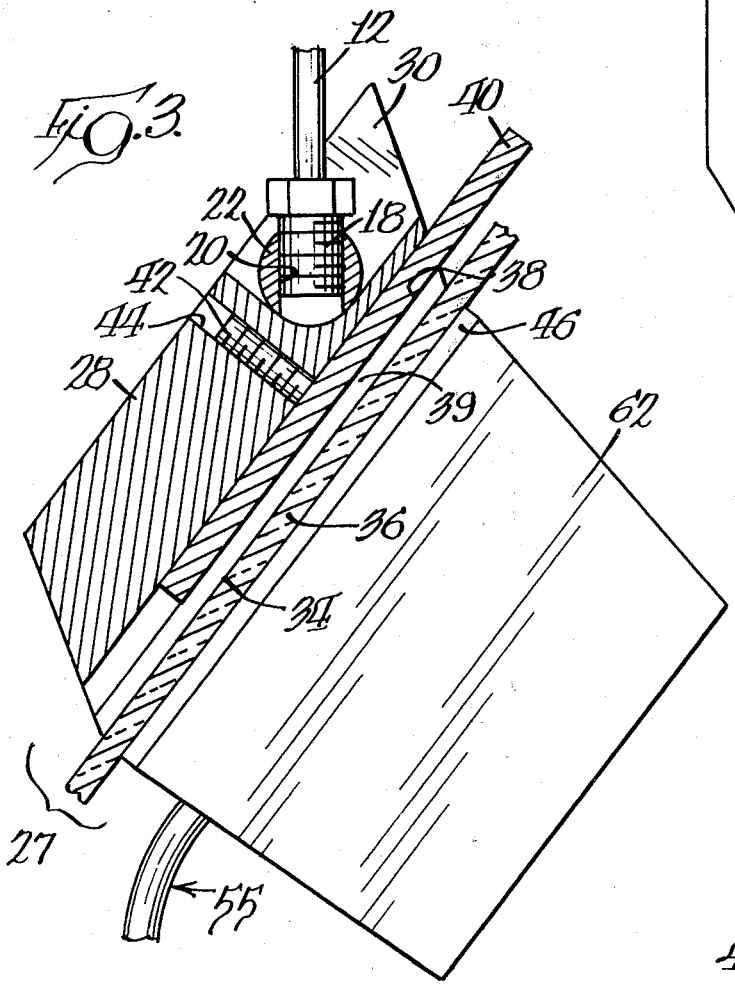
FIG. 3 is a sectional view taken along line 3—3 of FIG. 1.
Figure 4:
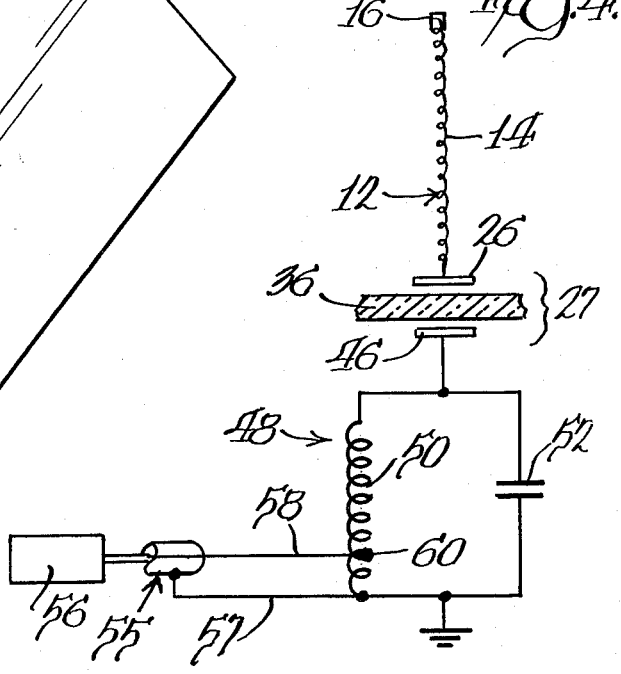
FIG. 4 is a schematic diagram of the assembly incorporating the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

Referring now to the drawings, there is shown a presently preferred embodiment of an antenna assembly 10 incorporating the present invention. Assembly 10 includes an electrically shortened, inductively loaded elongated half wave radiating member 12. The elongating radiating member 12, as shown, is designed for use in the C.B. frequency band (26.965–27.405 MHz), although antenna assemblies incorporating the present invention are not necessarily limited to these frequencies.

The radiating member or whip 12 is physically shorter than a half wave length (about eighteen feet for the C.B. frequencies) and is inductively loaded. The whip shown is continuously loaded by a generally helical, continuous coil 14 extending substantially the entire length of the whip 12. In one embodiment of the present invention, the coil 14 for loading the shortened whip 12 is comprised of No. 24 enamel coated copper wire in the form of a 1000 turn, closely spaced helical coil extending approximately 22 inches along the length of the fiberglass element of the antenna whip 12.

If desired, an antenna tip portion 16 (shown in dotted lines) may be adjustably affixed to the free end of the antenna whip 12. The tip portion 16 which would be electrically connected to the end of the coil 14 is designed to be axially adjusted with respect to the remainder of the antenna whip 12 to alter its effective length, thereby tuning the antenna to a particular resonant frequency in a known manner.

The base end of the atenna whip 12 is terminated in a conductive ferrule 18, to which the base end of the coil 14 is electrically connected. One end of the ferrule 18 is threaded and is received in a complementary threaded aperture 20 formed in the body of a conductive trunnion 22 transverse to the axis thereof.

The trunnion 22 is rotatably mounted within a transverse bore 24 formed in a first conductive member or base 26. Trunnion 22 is adapted to be locked in selected portions of rotation, as by a set screw or the like (not shown), such as, e.g., a member threaded into one end thereof for clamping the trunnion to the base. Base 26, as will appear, is electrically connected to the atenna whip via trunnion 22 and ferrule 18. Base 26 acts, in the preferred embodiment, as a tuning and loading member for the radiating member 12 and serves as one of the two plates comprising a coupling capacitor 27, for the antenna assembly 10 of the invention.

Base 26 is a generally solid, electrically conductive body which is disposed generally transversely to the axis of whip 12. Base 26 provides an upper surface 28 which is interrupted by a groove 30. This provides access to the trunnion 22. The threaded ferrule 18 passes through the groove 30 when threaded into the aperture 20 in trunnion 22. The groove 30 permits rotation of the trunnion 22 to facilitate angular adjustment of the whip 12 relative to the surface 28 of the base 26.

The upper surface 28 of the base 26 acts to capacitively load the inductively loaded antenna whip 12. The base 26 acts as a capacitor plate for the distributed capacitance between it and the antenna whip 12. In addition, the thickness of the base 26, which is about five-eighths inch in the embodiment illustrated, effectively increases the length of the whip 12, thereby decreasing the nominal resonant frequency of the antenna assembly. In the disclosed embodiment, the overall length of the whip 12 and base 26 is about two feet.

The lower surface 34 of the base 26 is affixed to and mounted on a non-conductive surface of a vehicle, such as one of the windows 36 of an automobile. If the vehicle itself is made of a non-conductive material such as wood or fiberglass as in the case of many marine vehicles and some automobiles, the base 26 may be mounted on any convenient portion of that vehicle. According to one embodiment of the present invention, the base is affixed to the exterior surface, as by a suitable adhesive which may conveniently be a heat sensitive or a contact adhesive.

The lower surface 34 of the base 26 defines a channel 38 extending the length thereof. The channel 38 may be closed or may be open at its base and include reentrant flanges 39 along the edge thereof, for retaining therein a slidably conductive insert or tuning slug 40. The tuning slug 40 is slidably received within the channel 38. The relative position of the tuning slug 40 with respect to the base 26, i.e., the extent to which it projects from one end of the channel 38 allows for further fine tuning of the resonant frequency of the antenna assembly 10 by effectively varying the surface area of the base 26 which, as stated, serves as a plate for the capacitor between the base and the whip. In the citizens band assembly disclosed in the preferred embodiment, the resonant frequency can be adjusted within about plus or minus four percent on either side of the center position of the slug 40, the position when it extends half way out of one end of the base 26.

When the antenna assembly 10 is properly tuned to the desired frequency, the slug 40 may be fixed in place, as by adhering it to the window 36 or by securing it in place by a set screw 42 threadedly received in a tapped hole 44 disposed between the upper and lower surfaces of the base 26.

Disposed on the inside surface of the window immediately opposite and in juxtaposition to the base or conductive member 26 is a further conductive member or coupling plate 46. As in the case of the base 26, plate 46 may be suitably cemented or otherwise mounted on the window 36. The base 26 and plate 46, together with the window 34 act as the coupling capacitor 27 located at a high impedance point, a voltage loop and current node, of the antenna assembly 10.

One end of a parallel tuned circuit 48 which includes a tapped coil 50 and a capacitor 52 is connected to a suitable connecting lug which projects from plate 46. The other end of the tuned circuit 48 is grounded. A transmission line 55, typically in the form of a coaxial cable, is connected between the tuned circuit 48 and a radio communications unit 56, e.g., a two way radio. The outer conductor or shield 57 of the coaxial cable or transmission line 55 is connected to the tuned circuit 48 at ground, and the center conductor 58 is connected to a tap 60 on the coil 50 at a point where the impedance of the tuned circuit 48 matches that of the transmission line 55, typically about 50 ohms.

In the disclosed embodiment, the tuned circuit is made up of a $25\frac{1}{4}$ turn coil on a $\frac{3}{8}$ inch phenolic form tuned with a powdered iron slug. The coil is tapped for connection to the transmission line 55 $1\frac{1}{4}$ turns away from the grounded end of the coil. The capacitor 52 is 8 pf, and is connected across the coil. This circuit is resonated at 27.2 mHz, approximately the center of the C.B. band.

The tuned circuit 48 appears to be multifunctional. Not only is it an impedance matching circuit between the base end of the antenna assembly 10 and the transmission line 55, but it also appears to simulate both a quarter-wave and an eighth-wave radiator to improve the radiation pattern and characteristics of the antenna assembly.

The tuned circuit 48 possesses characteristics of a quarter wave-length radiating member in that it is resonant at the nominal resonant frequency of the antenna assembly 10, its impedance at one end, where connected to the coupling plate 46, is sufficiently high to match the end impedance of the antenna, in the neighborhood of at least 100,000 ohms, and its impedance at the grounded end of the tuned circuit is substantially zero. It has been empirically determined, however, that when the tuned circuit is allowed to radiate, the effect on the radiation pattern from the whip 12 simultates the radiation pattern of a five-eighths wave-length antenna. In this regard it appears that the radiation pattern is somewhat flattened and therefore the combined assembly antenna 10 exhibits a gain over what would otherwise be expected from the whip 12.

In order to permit the tuned circuit to radiate, the plate 46 and the tuned circuit 48 are enclosed in a non-conductive, non-shielding tuning box cover 62 which is suitably retained on the plate 46.

Since the half wave antenna assembly of the present invention does not utilize the vehicle on which it is mounted as a ground plane, theoretically its radiation pattern should be independent of the vehicle and of the location on the vehicle at which the assembley is mounted. In practice, however, the radiation pattern is not totally independent of the vehicle, but it is less affected by the vehicle than is a quarter wave, ground plane antenna.

In the disclosed embodiment, in spite of the extent to which the antenna has been shortened, from about 18 feet to about 2 feet, the plot of standing wave ratio (SWR) vs. frequency over the 40 channels of the citizens band does show a suprisingly flat curve, at least when compared to a one-quarter wave antenna of similar length. When the antenna assembly of the present invention is mounted on the rear window of a vehicle and was tuned to 27.2 mHz, approximately the center of the 40 channel citizens band, the SWR at that frequency as measured was 1:1, while the SWR at either end of the frequency band as measured was approximately 2.1/2:1. This compares quite favorably with quarter wave ground plane antennas of similar length in which the SWR curves are usually considerably sharper and in which SWR at the resonant frequency is usually no lower than $1\frac{1}{2}$:1 and the SWR at either end of the C.B. band is typically about $3\frac{1}{2}$:1.

Thus, there has been disclosed a mobile half wave antenna assembly adapted to be mounted on non-conductive portions of a vehicle. In spite of the degree to which the antenna may have to be shortened, when designed as a C.B. antenna, the antenna provides satisfactory radiation patterns and is capable of being used over the entire frequency range of the citizens band.

The use of a half wave radiating member or whip permits the antenna to be affixed to a vehicle without requiring a ground plane. The antenna assembly which is thus mountable on non-conductive portions of the vehicle, utilizes an impedance matching circuit for coupling to the transmission line, which also beneficially affects the antenna radiation patterns with an antenna assembly of desired dimensions.

It is also apparent that the antenna assembly of this invention is adaptable not only to land-going vehicles but also to sea-going ones and that in many cases the antenna assembly is also adaptable to home and apartment uses where glass or other insulative or non-conductive surfaces may be used as a mounting surface for an antenna.

From the foregoing, it will be observed that numerous variations and modifications may be effected without departing from the true spirit and scope of the novel concept of the invention, It is, of course, intended to cover by the appended claims all such modifications as fall within the scope of the claims.

I claim:

1. A mobile transmitting and receiving communications antenna assembly for use on a vehicle comprising:

an antenna in the form of an elongated, substantially half wave-length radiating member;

a first electrically conductive tuning and loading member electrically connected to and disposed adjacent the base end of said antenna, said first conductive tuning and loading member being mounted on one side of a non-conductive body portion of said vehicle;

a second electrically conductive coupling member mounted on the other side of said non-conductive body portion in substantial juxtaposition with said first electrically conductive tuning and loading member, said first and second electrically conductive members defining with said non-conductive body portion a coupling capacitor at the end of said antenna located adjacent a current node thereof;

impedance matching means comprising a tuned circuit tuned to the nominal resonant frequency of said capacitively loaded antenna and electrically connected to said second electrically conductive coupling member in the immediate proximity thereof to resonate in conjunction with said one-half wave length radiating member, said impedance matching means displaying an impedance which varies between a first impedance at said connection to said second electrically conductive coupling member which is substantially equal to said impedance at the base end of said antenna and a secnd impedance at least several orders of magnitude less than said first impedance; and means for connecting transmission line means to said impedance matching means at a point where the impedance of said impedance matching means is substantially equal to the impedance of said transmission line.

2. An antenna assembly as claimed in claim 1 wherein:

said first electrically conductive tuning and loading member is mounted on said non-conductive body portion adjacent to and spaced from conductive body portions of said vehicle;

whereby the capacitance between said first electrically conductive tuning and loading member and said conductive vehicle body portions capacitively loads said antenna to modify the nominal resonant frequency thereof.

3. An antenna assembly as claimed in claim 2 wherein:

said impedance matching means comprises a parallel tuned circuit tuned to the nominal resonant frequency of said capacitively loaded antenna.

4. An antenna assembly as claimed in claim 1 wherein:

the impedance of said impedance matching means at said transmission line connection point is approximately 50 ohms to match the impedance of the transmission line means to be connected thereto, and the impedance of said antenna at the base end of said antenna is in excess of 25,000 ohms.

5. An antenna assembly as claimed in claim 4 wherin:

the impedance of said antenna at the base end thereof is at least about 100,000 ohms.

6. An antenna assembly as clamed in claim 4 wherein:

said impedance matching means comprises a parallel tuned circuit tuned to the nominal resonant frequency of said antenna.

7. An antenna assembly as claimed in claim 1 including:

transmission line means for connection between said antenna assembly and a radio communications unit, said transmission line means having an impedance orders of magnitude less than the impedance of said antenna at the base end thereof.

8. An antenna assembly as claimed in claim 7 wherein:

the impedance of said impedance matching means at said transmission line connection point is approximately 50 ohms to match the impedance of said transmission line means, and the impedance of said antenna at the base end of said antenna is in excess of 25,000 ohms.

9. An antenna assembly as claimed in claim 8 wherein:

the impedance of said antenna at the base end thereof is at least about 100,000 ohms.

10. An antenna assembly as claimed in claim 9 wherein:

said impedance matching means comprises a parallel tuned circuit tuned to the nominal resonant frequency of said antenna.

11. An antenna assembly as claimed in claim 1 wherein:

said first electrically conductive tuning and loading member has a surface disposed transverse to the axis of said elongated radiating member to capacitively load said antenna, whereby said antenna is resonant at approximately the nominal design frequency thereof.

12. An antenna assembly as claimed in claim 11 wherein:

said first electrically conductive tuning and loading member includes means for varying the surface area thereof;

whereby the capacitive loading of said antenna may be adjusted to alter the nominal resonant frequency of said antenna.

13. An antenna assembly as claimed in claim 12 wherein:

said surface area altering means comprises a conductive insert electrically connected to said first electrically conductive tuning and loading member and movable relative thereto between a retracted position wherein the surface area of said first electrically conductive tuning and loading member is unchanged and selected extended positions where the surface area of said first electrically conductive tuning and loading member is increased.

14. An antenna assembly as claimed in claim 13 wherein:

the impedance of said impedance matching means at said trasmission line connection point is approximately 50 ohms to match the impedance of the transmission line means to be connected thereto, and the impedance of said antenna at the base end of said antenna is in excess of 25,000 ohms.

15. An antenna assembly as claimed in claim 1 wherein:

said half wave-length radiating member is inductively loaded and has a physical length substantially shorter than a half wave-length at the nominal resonant frequency of said antenna.

16. An antenna assembly as claimed in claim 15 wherein:

said radiating member is continuously loaded by a helical coil extending a substantial portion of the length thereof from the base end towards the other free end thereof;

said radiating member having an electrical length substantially equal to a half wave-length at the nominal resonant frequency of said antenna.

17. An antenna assembly as claimed in claim 16 wherein:

the length of said radiating member is at least about two feet.

18. An antenna assembly as claimed in claim 17 wherein:

the length of said radiating member is between about two feet and about three feet.

19. An antenna assembly as claimed in claim 15 wherein:

the impedance of said impedance matching means at said transmission line connection point is approximately 50 ohms to match the impedance of the trnasmission line means to be connected thereto, and the impedance of said antenna at the base end of said antenna is in excess of 25,000 ohms.

20. An antenna assembly as claimed in claim 19 wherein:

the impedance of said antenna at the base end thereof is at least about 100,000 ohms.

21. An antenna assembly as claimed in claim 20 wherein:

said impedance matching means comprises a parallel tuned circuit tuned to the nominal resonant frequency of said antenna.

22. An antenna assembly as claimed in claim 15 wherein:

said first electrically conductive tuning and loading member has a surface disposed transverse to the axis of said elongated radiating member to capacitively load said antenna, whereby said antenna is resonant at approximately the nominal design frequency thereof.

23. An antenna assembly as claimed in claim 22 wherein:

said first electrically conductive tuning and loading member includes means for varying the surface area thereof;

whereby the capacitive loading of said antenna may be adjusted to alter the nominal resonant frequency of said antenna.

24. An antenna assembly as claimed in claim 23 wherein:

said surface area altering means comprises a conductive insert electrically connected to said first electrically conductive tuning and loading member and movable relative thereto between a retracted position wherein the surface area of said first electrically conductive tuning the loading member is unchanged and selected extending positions where the surface area of said first electrically conductive tuning and loading member is increased.

25. An antenna assembly as claimed in claim 22 wherein:

said first electrically conductive tuning and loading member comprises an electrically conductive body, the thickness of said body effectively lengthening said elongated radiating member, thereby lowering the nominal resonant frequency thereof.

26. An antenna assembly as claimed in claim 25 wherein:

said first electrically conductive tuning and loading member comprises a generally solid body having a thickness of about five-eighths inch.

27. An antenna assembly as claimed in claims 15 or 22 wherein:

said first electrically conductive tuning and loading member is mounted on said non-conductive body portion adjacent to and spaced from conductive body portions of said vehicle;

whereby the capacitance between said first electrically conductive tuning and loading member and said conductive vehicle body portions further capacitively loads said antenna to modify the nominal resonant frequency thereof.

28. An antenna assembly as claimed in claim 15 wherein:

said impedance matching means comprises a parallel tuned circuit tuned to the nominal resonant frequency of said antenna.

* * * * *

UNITED STATES PATENT AND TRADEMARK OFFICE

CERTIFICATE OF CORRECTION

PATENT NO. : 4,238,799

DATED : December 9, 1980

INVENTOR(S) : Dale R. Parfitt

It is certified that error appears in the above-identified patent and that said Letters Patent are hereby corrected as shown below:

Column 4, line 65: "atenna" should be --antenna--;

Column 10, line 29: "the" should be --and--;

Column 10, line 30: "extending" should be --extended--.

Signed and Sealed this

*Seventeenth* Day of *March 1981*

[SEAL]

*Attest:*

RENE D. TEGTMEYER

*Attesting Officer*

*Acting Commissioner of Patents and Trademarks*